United States Patent [19]

Nishijyo

[11] 4,124,332

[45] Nov. 7, 1978

[54] AUTOMATICALLY OPERATIVE PUMPING EQUIPMENT

[75] Inventor: Masaru Nishijyo, Kadoma, Japan

[73] Assignee: Matsushita Electric Industrial Company, Limited, Japan

[21] Appl. No.: 687,619

[22] Filed: May 18, 1976

[30] Foreign Application Priority Data

| | | | |
|---|---|---|---|
| May 19, 1975 | [JP] | Japan | 50/60385 |
| Jun. 4, 1975 | [JP] | Japan | 50/76318[U] |
| Jun. 4, 1975 | [JP] | Japan | 50/76319[U] |
| Jun. 13, 1975 | [JP] | Japan | 50/80770[U] |
| Dec. 5, 1975 | [JP] | Japan | 50/145715 |
| Dec. 5, 1975 | [JP] | Japan | 50/145716 |

[51] Int. Cl.[2] ..... F04B 49/08

[52] U.S. Cl. ..... 417/26; 417/38

[58] Field of Search ..... 417/38, 44, 18, 20, 417/26

[56] References Cited

U.S. PATENT DOCUMENTS

| | | | |
|---|---|---|---|
| 1,560,044 | 11/1925 | Derrick | 417/44 |
| 3,692,430 | 9/1972 | Timmons | 417/44 |
| 3,694,105 | 9/1972 | Martin | 417/26 |
| 3,871,792 | 3/1975 | Gritz | 417/38 |
| 3,931,830 | 1/1976 | Gritz | 417/38 |

*Primary Examiner*—William L. Freeh

*Attorney, Agent, or Firm*—Robert E. Burns; Emmanuel J. Lobato; Bruce L. Adams

[57] ABSTRACT

The present invention relates to automatically operative pumping equipment. A by-pass passage is installed branching off from the delivery pipe and meeting the vacuum pipe of a pump driven by an electric motor, the by-pass passage being equipped with pressure regulating means operable in response to the water pipe pressure at the pump delivery side, and by-pass passage regulating means controlled in response to a signal from a flow rate sensor on the pump delivery side, whereby the pressure on the pump delivery side is regulated by the by-pass regulating means and pressure regulating means thereby to automatically control pump operation in response to command signals from a pressure switch.

17 Claims, 21 Drawing Figures

AUTOMATICALLY OPERATIVE PUMPING EQUIPMENT

At the present time automatically operating water supply pumps, or the so-called shallow well pumps for home use, are of the Wesco pump type having a self-suction capability. Normally, these shallow well pumps are used to pump water through a distance of eight meters or less from the water table of the well to the ground surface or the mounting position of the pump. To exceed this distance of eight meters, deep well pumps are used which combine Fugal pumps and jet pumps. In such pumps, operation is controlled automatically by opening and closing a faucet. To effect this automatic operation, a pressure switch connected to the water pipe on the delivery side of the pump is actuated by a pressure variation in the water pipe on the delivery side caused by opening and closing the faucet, whereby the pressure switch is operable to turn the circuit of a pump driving motor ON and OFF.

Connected to the water pipe on the delivery side is a water tank associated with the pressure switch. For reasons to be explained hereinafter, this water tank for domestic wells must be of an extremely large size consisting of pressed steel plates.

As a first reason, the number of times the pressure switch for automatic operation of the pump opens or closes is restricted so as not to exceed a limited number of operations. As a result, the pump stops with as long as possible a time period required before operation is re-initiated. When this condition is not achieved, the pressure switch is subject to damage in a short time interval, rendering automatic pump operation and water supply impossible.

When determining the size of a conventional pressure tank, the following values are adopted as criteria:

$$\Delta V = V(1/P_{on} - 1/P_{off}) \quad (1),$$

wherein $\Delta V$: the amount of accumulated water (liters),

V: capacity of the pressure tank $P_{on}$: pressure when the pressure switch is ON (gauge pressure in kg/cm$^2$)

$P_{off}$: pressure when the pressure switch is OFF (gauge pressure in kg/cm$^2$)

$$Q = (Q_{on} + Q_{off})/2 \quad (2),$$

wherein $Q_{on}$: pump flow rate (1/min) during $P_{on}$ pressure $Q_{off}$: pump flow rate (1/min) during $P_{off}$ pressure $$T = \Delta V/Q \text{ (min)} \quad (3).$$

T in the formula (3) is adopted as the criterion. Choosing as large a value for T as possible reduces the number of ON-OFF operations for the pressure switch, enabling the lifetime of the switch to be lengthened. In other words, it is preferable that the capacity of the pressure tank be enlarged.

As a second reason especially important when employing a Wesco pump, it is a characteristic of a pump of this type that when the flow rate decreases, an excessive load is applied upon the electric motor which drives the pump, thereby leading to an extremely sharp increase in power consumption, an important disadvantage. For example, in a Wesco pump at a flow rate of 30 liters/min, power consumption increases by approximately 2–2.5 times when the flow rate approaches zero. As the power consumption rises, the electric motor is subject to insulation damage and overheating while pump efficiency (pump water power/electrical input) deteriorates and running costs rise substantially.

The load connected to the pump of a domestic well is generally small in size and therefore invites a considerably small pump flow rate such as is usually associated with faucets or the like. As this is an important defect in Wesco pumps, some means must be found to prevent the pump flow rate from falling below a predetermined value.

The disadvantage outlined above can be overcome by utilizing a large-scale pressure tank. Namely, even if the flow rate through the water pipe is small, a large water tank capacity enables the difference in the flow rate between the pump flow rate and water pump flow rate to be sufficiently increased and fed into the tank. It is therefore possible to provide a design wherein the pump flow rate can, in any case whatsoever, be prevented from falling below a set flow rate. Various means have been considered for extending the ON-OFF cycle of the pressure switch, such as employing a delaying element. This, however, is not practical in view of the problems encountered in the second reason as mentioned hereinabove.

According to the reasons as above-mentioned, domestic well pumps utilizing large-scale pressure tanks are at present commercially available. However, in recent years there has been a growing trend toward the production of smaller, light-weight products which are now preferred, and manufacturers have geared production to this end.

In FIG. 17, a widely-used, conventional automatically operating pump system is illustrated. Numeral 123 represents a pump, with water from well 124 drawn through well water pipe 125, check valve 126 and suction pipe 127 and fed to faucet 130 through delivery pipe 128 and water supply pipe 129. Pressure switch 132 for controlling the pump actuating motor 131 is connected to delivery pipe 128 as is large-scale pressure tank 133 coupled to switch 132.

When faucet 130 is opened, water stored in pressure tank 133 is discharged, the pressure within water supply pipe 129 falls and pressure switch 132 is set to ON, thereby actuating motor 131 and bringing pump 123 into automatic operation. If faucet 130 is shut off, the pressure within water supply pipe 129 rises, turning switch 132 OFF and terminating the activity of pump 123.

As conventional domestic well pumps are not equipped with water regulating means, an operation to be hereinafter described repetitively takes place. Namely, when faucet 130 is wide open, the pressure within water supply pipe 129 does not attain a pressure suitable for turning pressure switch 132 OFF, with the result that pump 123 continues to operate. Conversely, when faucet 130 is shut completely off, the pressure within water supply pipe 129 does attain a pressure suitable for turning pressure switch 132 OFF. Although this terminates operation of pump 123, water stored in pressure tank 133 is supplied to water supply pipe 129, and the pressure in delivery pipe 128 and water supply pipe 129 gradually decreases. Owing to the presence of check valve 126, there is no reverse flow of water from the pressure tank 133 through suction pipe 127 so that water is supplied solely to water supply pipe 129, which then attains a pressure suitable for turning pressure switch 132 ON, thereby automatically bringing pump 123 once again into operation. Water is thus drawn up from well 124 and the actions are repeated while a portion of the water is stored in pressure tank 133. Since the interval of time between the ON and OFF operations of pressure switch 132 is determined by the capacity of pressure tank 133, employing a tank of large capacity extends the time interval.

Domestic well pumps available for use at the present time generally have a capacity of 20 liters; approximately 50% of such wells are of this type. It has been estimated that in 20 liter pressure tanks the ON-OFF cycle of pressure switch 132 is about 30 seconds in duration. Since the lifetime of domestic well pumps is 10,000 hours, the pressure switch will be switched ON or OFF approximately 1,200,000 times over this period of time. As the lifetime of a standard pressure switch will permit about 1,000,000 switching operations, simply reducing the capacity of the pressure tank to 1/10 of the original capacity reduces the lifetime of the switch to 1,000 hours for 1,200,000 switching operations. Accordingly, the capacity of the pressure tank cannot merely be reduced with favorable results.

With respect to the power consumption of motor 131, on the other hand, even when a Wesco pump is operated under a pressure which turns pressure switch 132 ON, operation is conducted in the vicinity of a value which will not apply an excessive load to the motor. Thus, regardless of how many times the pressure switch should repeat the ON-OFF operation, motor 131 suffers no damage.

When faucet 130 is fully closed, water supply pipe 129 and delivery pipe 128 rise in pressure, causing switch 132 to turn OFF. Due to the increase in pressure within the pressure tank 133, the pressure of water supply pipe 129 holds the pressure switch in the OFF condition which in turn keeps pump 123 in the non-operative state awaiting the opening of the faucet 130. When the faucet is opened, water stored in pressure tank 133 is discharged and pressure switch 132 is turned ON to repeat the above operation due to a drop in pressure in water supply pipe 129. Such is the automatic operation of a conventional domestic well pump.

As means for simply reducing the number of ON-OFF operations of pressure switch 132, the apparatuses as shown in FIGS. 18 and 19 are already known.

In FIG. 18 a movable element 136 capable of changing position in accordance with water flow is provided in the delivery line 135 of pump 134. Inlet passage 138 of pressure switch 137 is opened or closed according to the position of movable element 136, thereby controlling pressure switch 137.

In FIG. 19, valve 140 operative during discharge of pump 139 is provided, said valve 140 and auxiliary valve 141 operative to control input to pressure tank 143 which is equipped with pressure switch 142.

In FIG. 18, the numeral 145 represents an electric motor, 146 a pressure tank, 147 a line on the pressure side, and 148 a spring for biasing movable element 136.

In FIG. 19, 149 represents a connector between outlet valve 140 and auxiliary valve 141, 150 a spring for setting movement, and 151 an electric motor.

As well known, the pressure switch is employed to control the flow rate through the water supply pipe. When such flow rate is above an established value, the pressure switch operates to keep the pump in a continuously operative condition irrespective of the pressure in the water supply pipe. When the flow rate begins to fall below the value of the established flow rate, the pressure switch allows the pump to operate automatically in relation to the pressure of the water supply pipe.

In FIG. 20, in addition to the provision of the pressure switch 153 which is operatively connected to pressure tank 120 rate switch 155 is provided for sensing the flow rate through water pipe 154. When the flow rate switch is operative, pump 156 runs normally; when inoperative, the pump is allowed to run automatically as governed by pressure switch 153.

According to these mechanisms, if the operating flow rate is reduced by the flow rate switch, the range of continuous pump operation can be greatly extended. However, when these conventional devices are applied in Wesco pumps, the following disadvantages become evident.

(1) Since the Wesco pump is urged to operate irrespective of the pressure switch, over-loading of the pump cannot be avoided.

(2) When the flow rate through the water pipe is reduced, operation in conformance to the pressure switch ceases; therefore, the pressure at which the pressure switch turns OFF must be set below the pump delivery pressure. In other words, a by-pass flow passage is required for the Wesco pump in order to prevent motor overload; when the delivery pressure of the Wesco pump is held below such an overloading-operative condition, it is necessary to keep the pressure at which the pressure switch turns OFF below this value. When doing so, the amount of water stored in the pressure tank decreases since this amount is related to the ON-OFF operation of the pressure switch. Accordingly, when the flow rate through the water pipe is below a set value, such as when there is a leak at the faucet, an inconvenient situation develops in which the number of ON-OFF operations of the pressure switch increases due to the small quantity of water stored in the pressure tank.

(3) Flow rate switches are high in cost and lack durability since electrical contacts are of the 2-point contact type.

The present invention seeks to provide novel, automatically operative pumping equipment designed to preclude the above-mentioned disadvantages. It is therefore the prime object of this invention to provide compact, light-weight pumping equipment in which the capacity of the pressure tank for a shallow, domestic well pump employing in particular a Wesco pump, is greatly reduced.

It is another object of this invention to provide means which prevent overloading of a Wesco pump despite a pressure tank of reduced capacity.

It is still another object of this invention to provide means which prevent vibration of the domestic pump apparatus by providing overload prevention means.

It is still yet another object of this invention to provide means which extend the range of continuous Wesco pump operation, thereby substantially reducing the range of pressure switch ON-OFF operation.

It is still another object of the present invention to provide means for maintaining at an equal level the water pipe pressure which actuates the pressure switch, and to do so despite changes in the actual flow rate through the water pipe.

It is still another object of this invention to provide means which enable a sufficiently effective amount of water to be stored by an extremely small pressure tank even in such cases where there is a minute flow rate through the water pipe, for example, when there is a leak at the water faucet.

It is still another object of this invention to provide means which prevent equipment breakdown due to contaminants contained in the operating water.

It is still another object of this invention to provide means which can reduce, to as large an extent as possible, damage inflicted upon the water supply pipe due to the supplied pressure.

It is still another object of this invention to provide regulatory means which prevent variations in the output pressure of the disclosed domestic well pump.

Figure 4A:
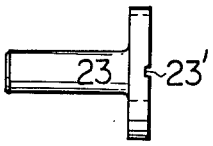
Figure 4B:
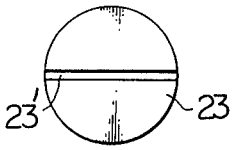
Figure 5:
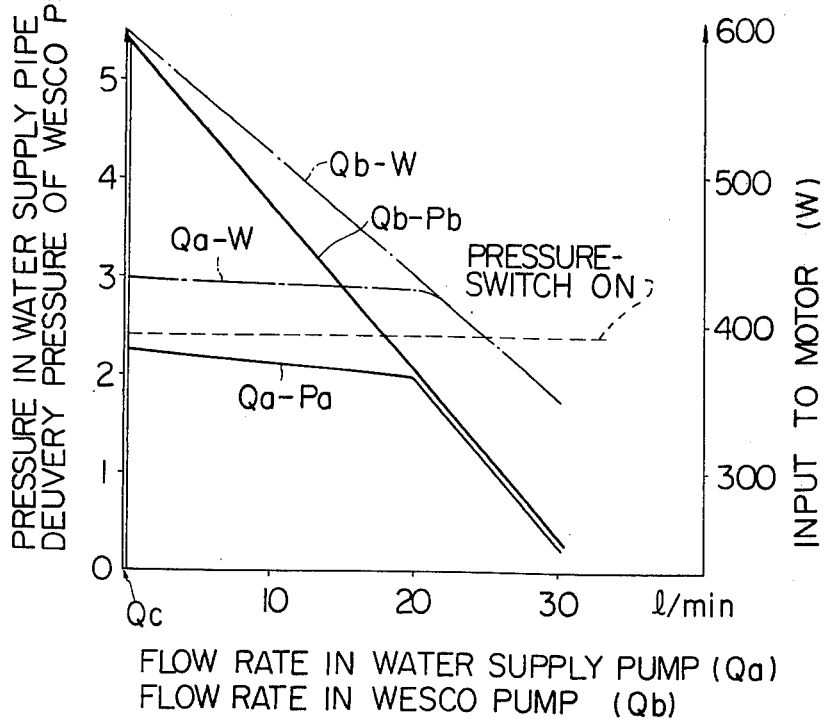
Figure 6:
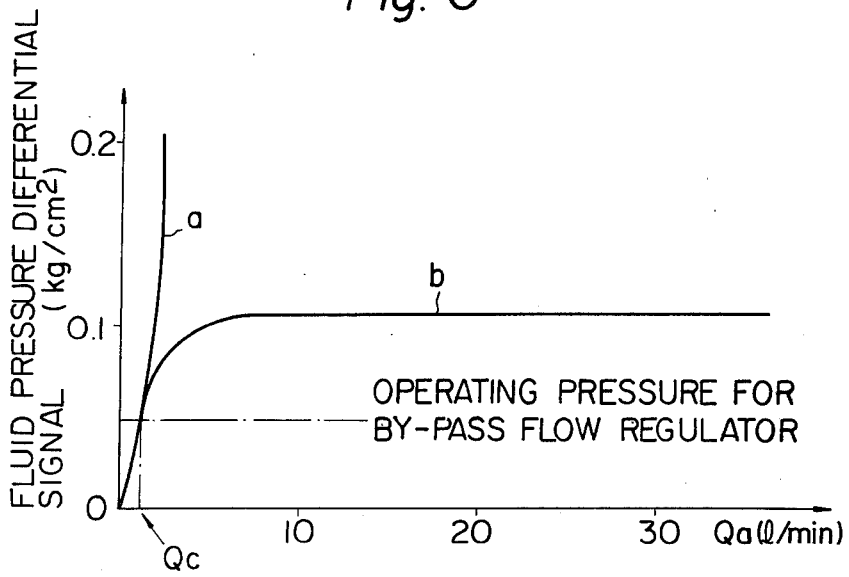
Figure 7:
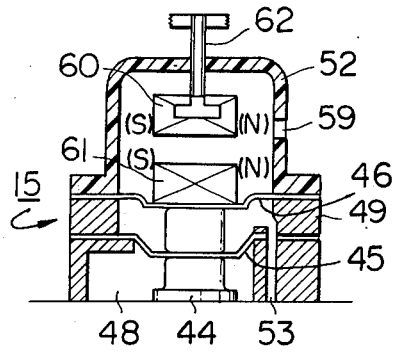
Figure 8:
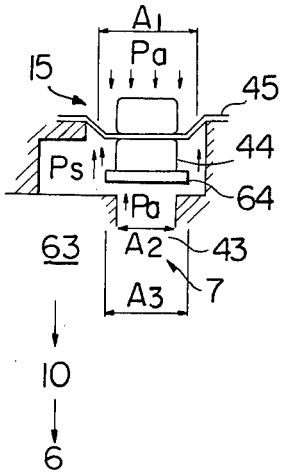
Figure 9:
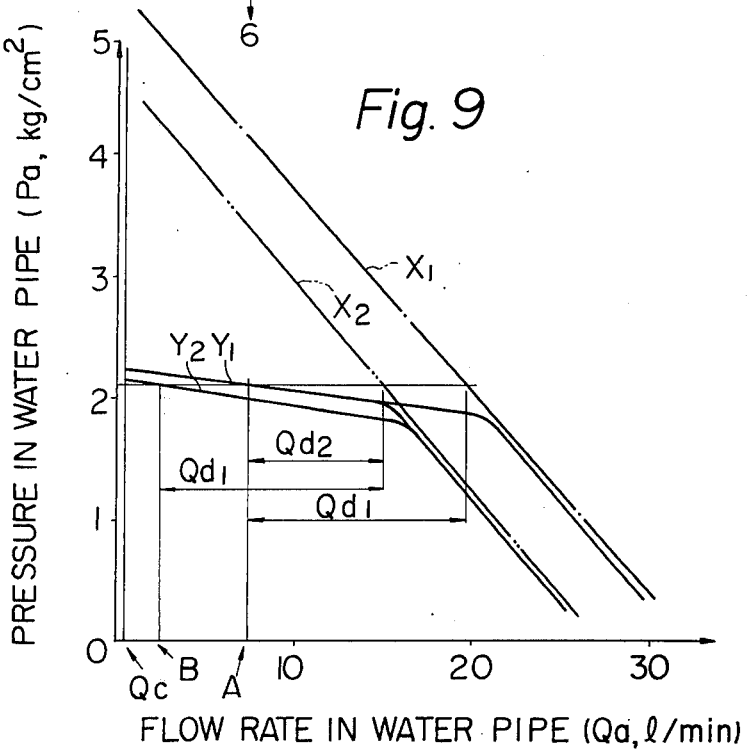
Figure 10:
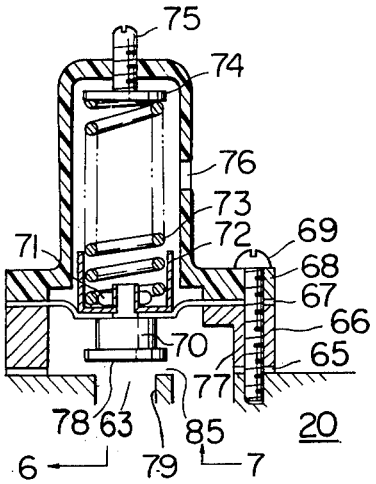
Figure 11:
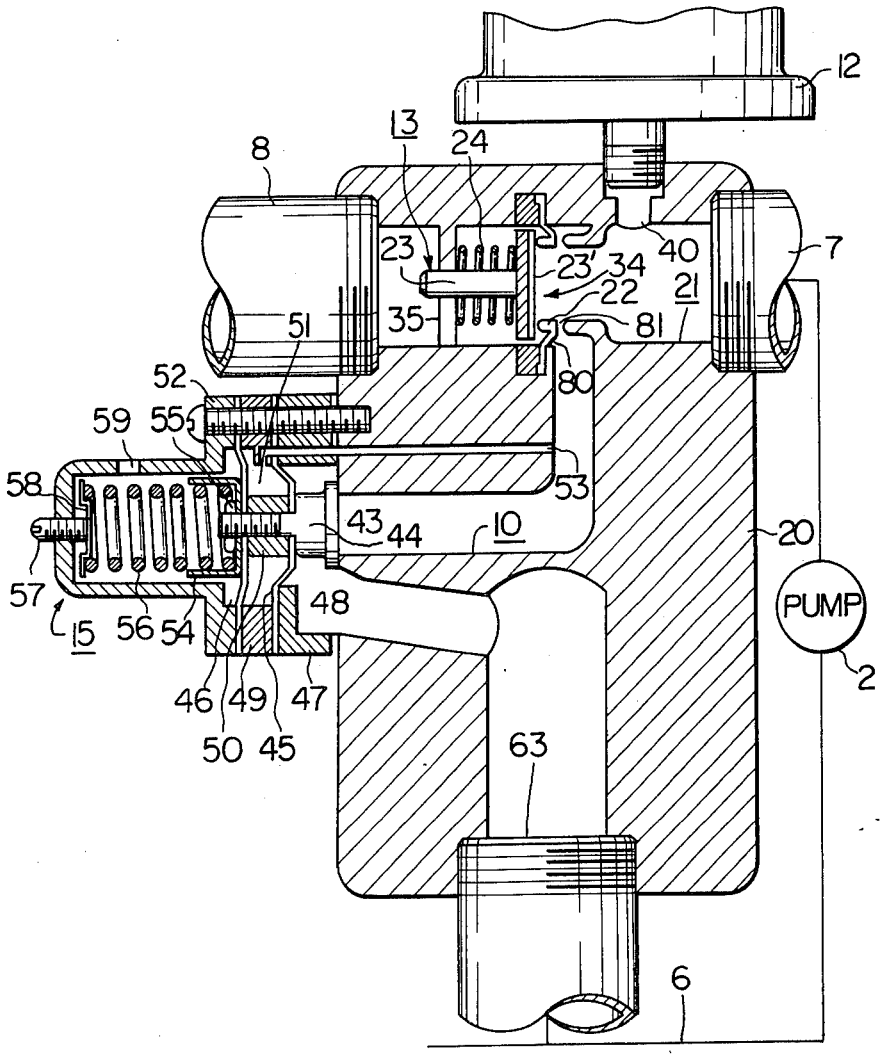
Figure 12:
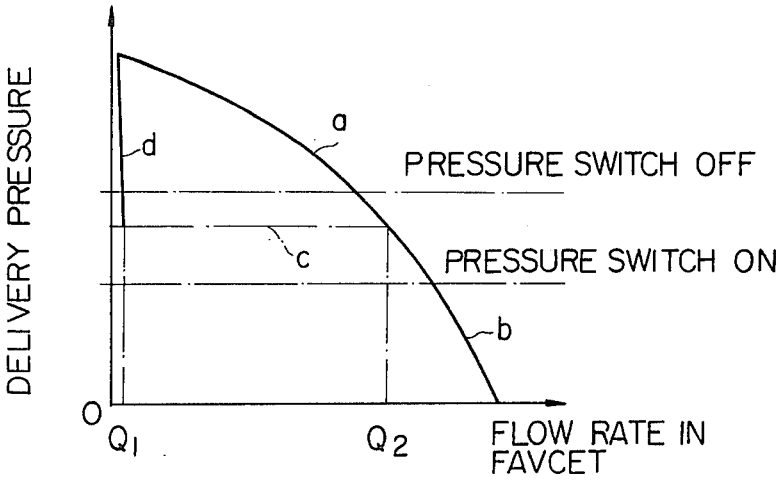
Figure 13:
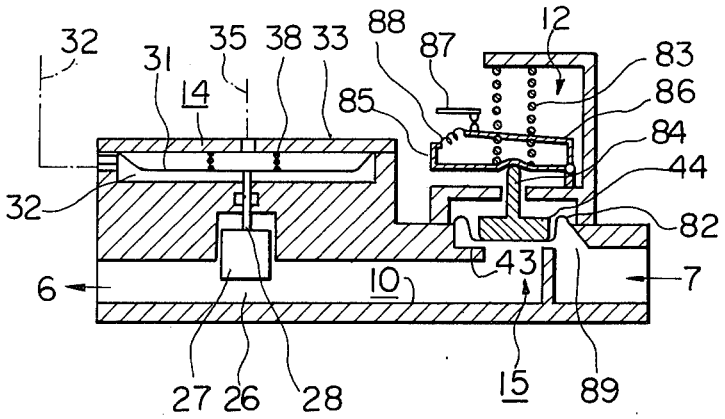
Figures 14, 15:
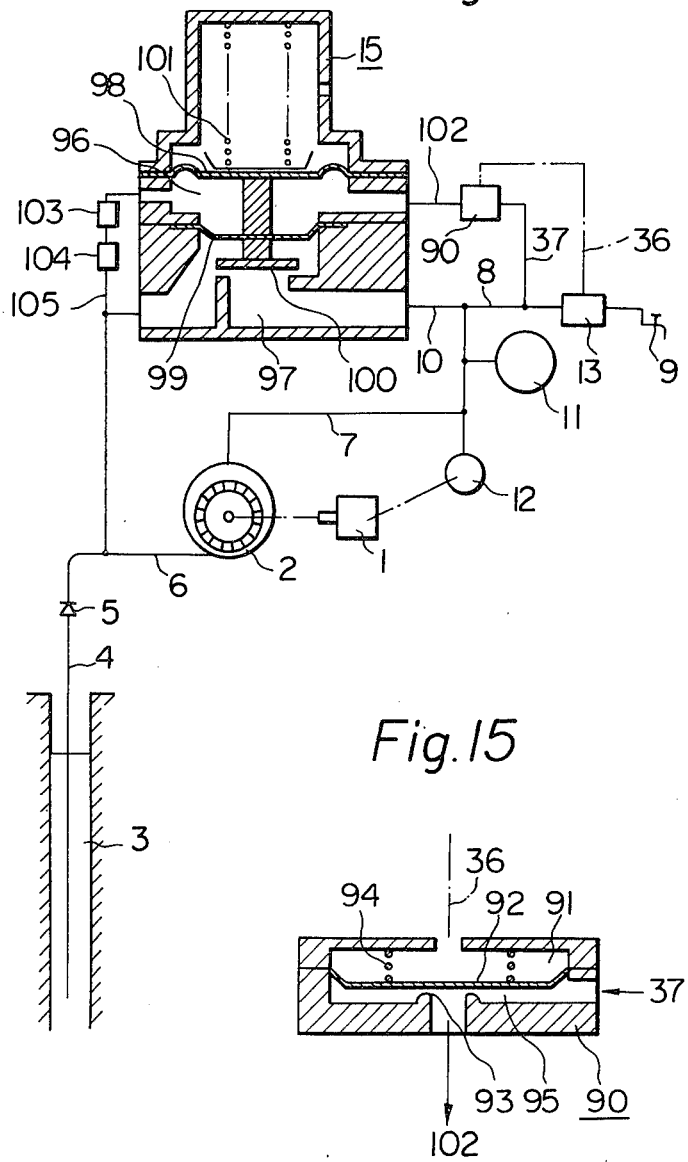
Figure 16:
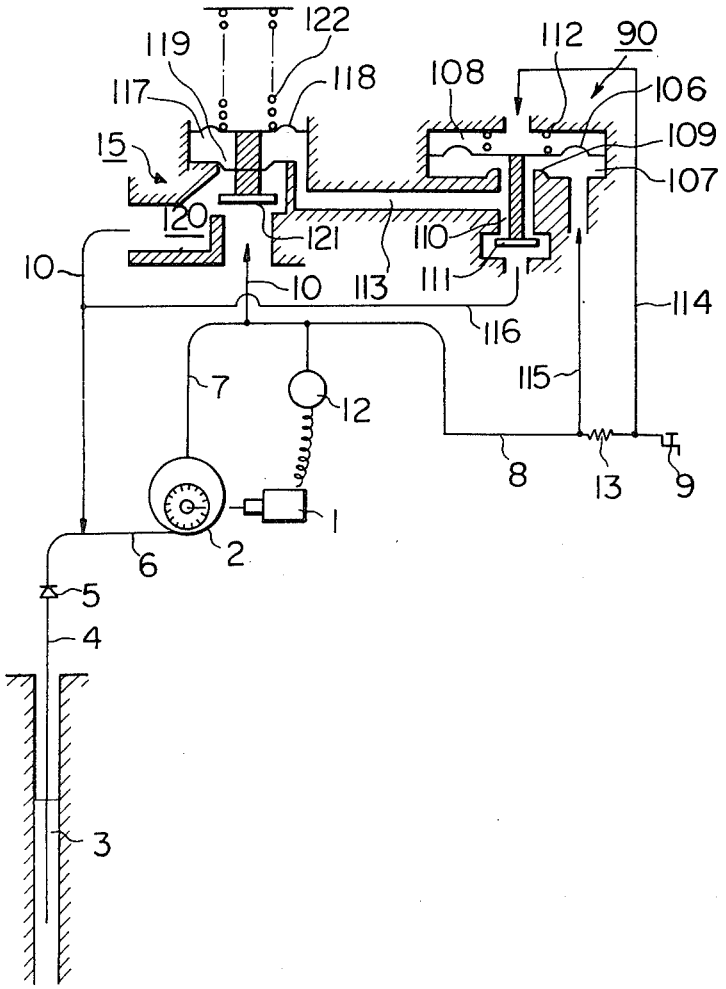
Figure 17:
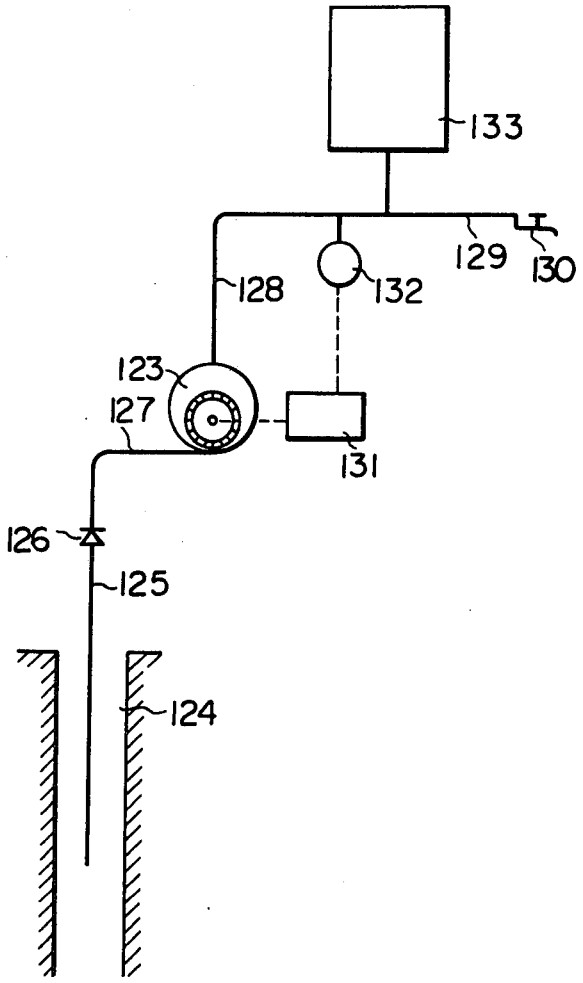
Fig. 17 Prior Art
Figure 18:
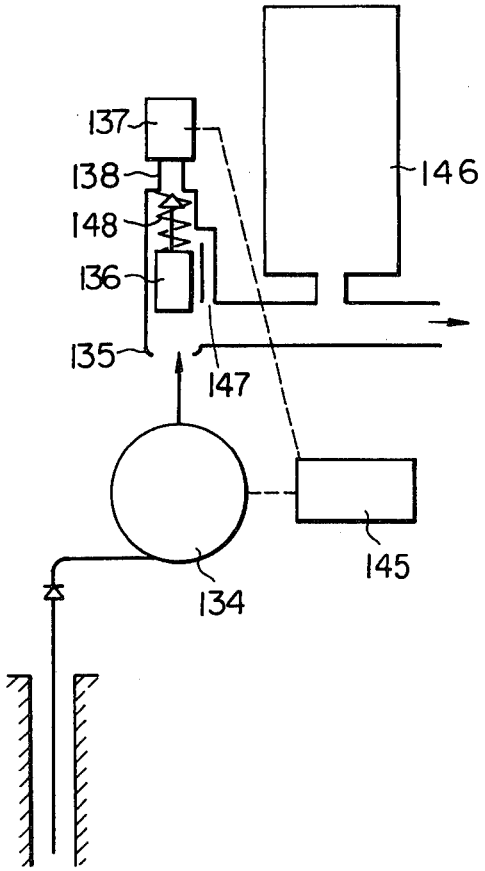
Fig. 18 Prior Art
Figure 19:
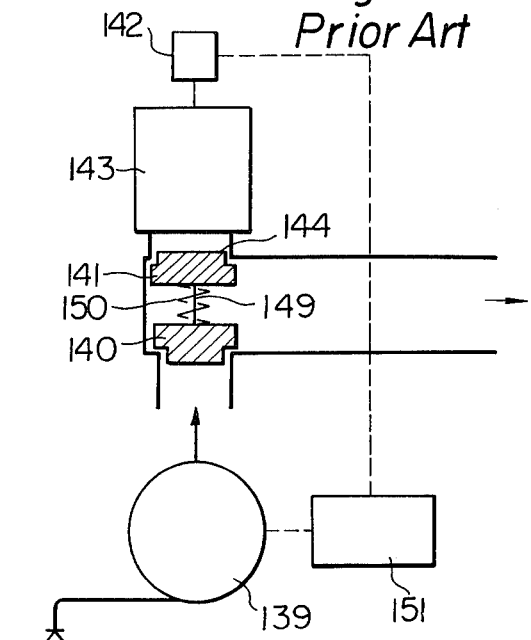
Fig. 19 Prior Art
Figure 20:
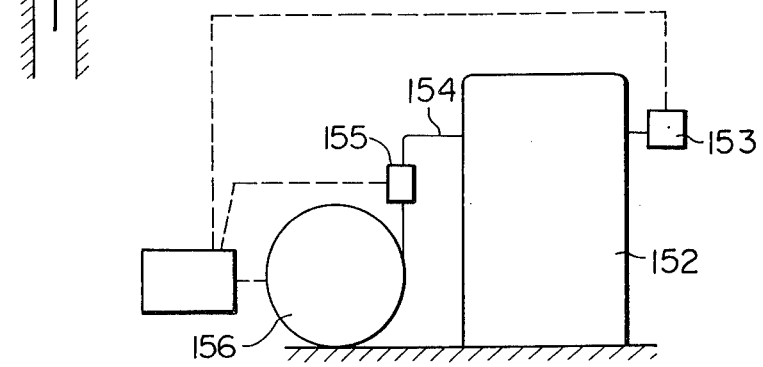
Fig. 20 Prior Art

FIGS. 4*a* and 4*b* respectively illustrate a side view and end view of the resistance valve of the flow rate sensor;

FIG. 5 illustrates a graph showing the operational characteristics of the pumping equipment of the present invention;

FIG. 6 illustrates a graph showing the fluidic pressure characteristics of the flow rate sensor;

FIG. 7 illustrates a cross-sectional view of the pressure regulator in conformance with another embodiment of the present invention;

FIG. 8 illustrates an operational description of the same pressure regulator;

FIG. 9 illustrates a graph showing the characteristics of the pressure regulator;

FIG. 10 illustrates a cross-sectional view of the pressure regulator of the former art;

FIG. 11 illustrates a cross-sectional view of the water regulator in conformance with another embodiment of the present invention;

FIG. 12 illustrates a graph showing the flow rate and pressure switch characteristics of the present invention;

FIG. 13 illustrates a cross-sectional view of the water regulator in conformance to another embodiment of the present invention;

FIG. 14 illustrates the water regulator system in conformance with another embodiment of the present invention;

FIG. 15 illustrates a cross-sectional view of the control valve of FIG. 14;

FIG. 16 illustrates the water regulator system in conformance with another embodiment of the present invention;

FIG. 17 illustrates the flow passage system of the pumping equipment of the prior art;

FIG. 18 illustrates the construction of the water regulator for the pumping equipment of the prior art;

FIG. 19 illustrates the construction of another embodiment of the pumping equipment of the prior art; and FIG. 20 illustrates the construction of another embodiment of the pumping equipment of the prior art.

Figure 1:
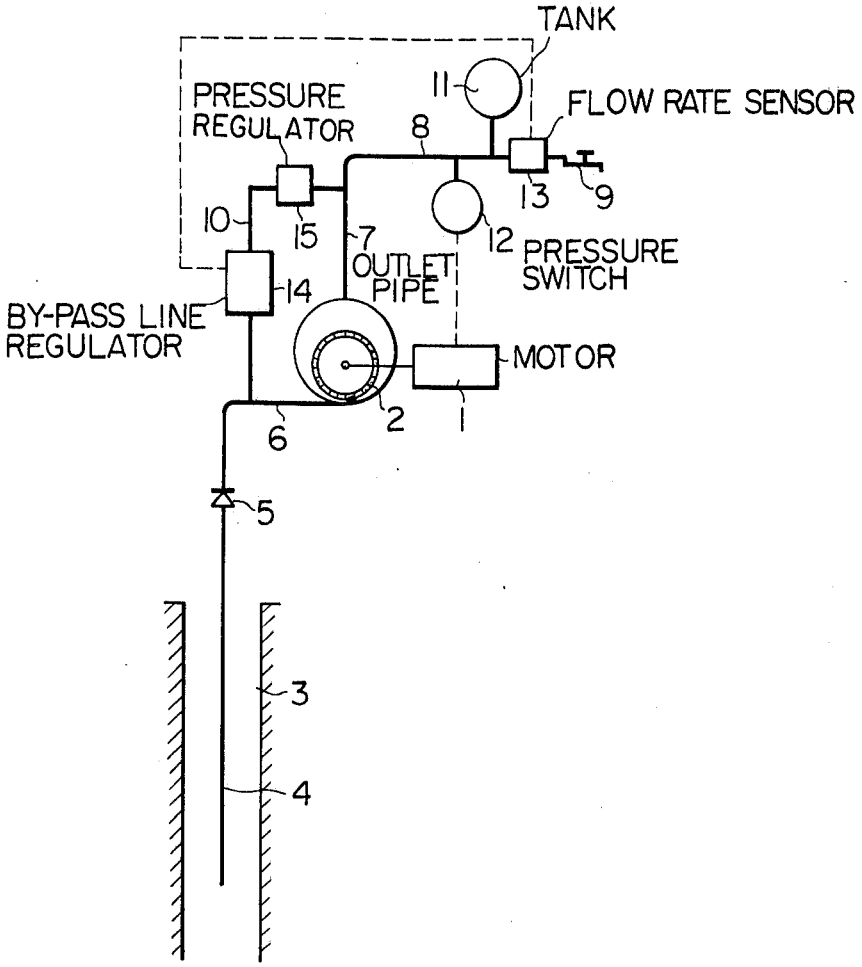
FIG. 1 illustrates the flow line system of the pumping equipment of this invention.

FIG. 1 of the drawings illustrates the flow passage construction for the automatically operative pumping equipment of the present invention, wherein numeral 1 represents an electric motor which drives pump 2 of Wesco type. Pump 2 draws water from well 3 through well water pipe 4, check valve 5 and suction pipe 6 from whence it is supplied to faucet 9 via delivery pipe 7 and water supply pipe 8. A by-pass flow line 10 is formed, branching off from delivery pipe 7 and connecting with suction pipe 6. Connected to delivery pipe 7 of pump 2 are compact pressure tank 11 and pressure switch 12 which actuates motor 1 when the pressure for turning the switch ON is greater than the pressure for turning it OFF. A flow rate sensor 13 is provided in water supply line 8.

By-pass line 10 is equipped with by-pass line regulator 14 controlled in response to a signal from flow rate sensor 13, and is further equipped with pressure regulator 15 controlled in response to the delivery pressure of pump delivery pipe 7.

Figure 2:
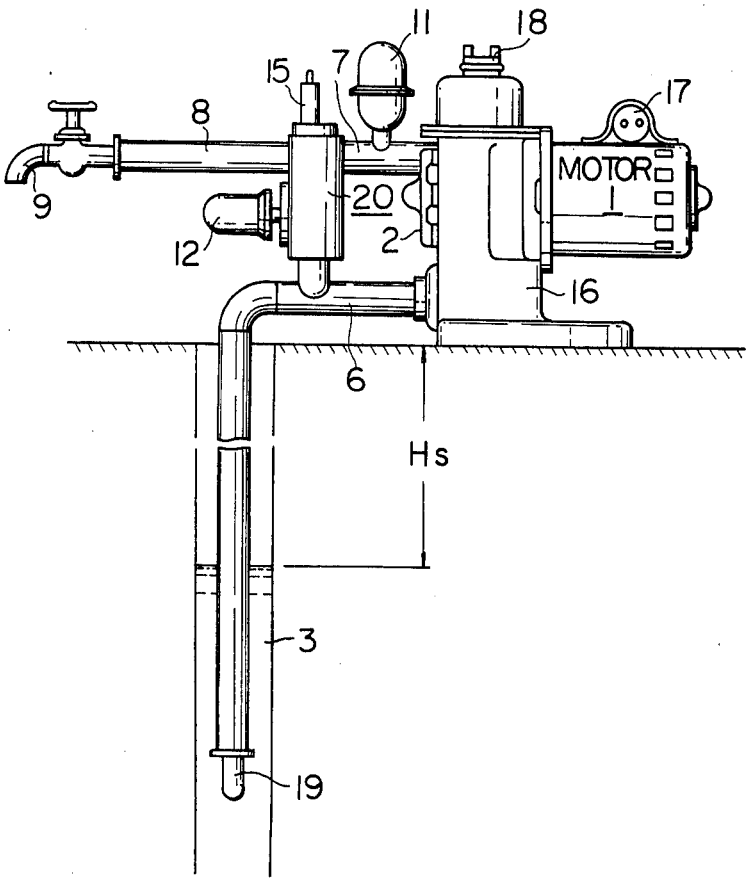
FIG. 2 illustrates the external appearance of an identical embodiment of the pumping equipment.

FIG. 2 illustrates more concretely the construction of FIG. 1, wherein 1 represents an electric motor which drives pump 2 of Wesco type mounted to casing 16. The numeral 17 is a condensor actuated by motor 1 in response to an electric power source (not shown). The numeral 18 is a water injection port located at the upper portion of pump 2 for injecting priming water into the system, 6 is the delivery pipe of pump 2, 19 a foot valve provided at the lower end of suction pipe 6, 7 the delivery pipe of pump 2, 20 a water regulator provided in the by-pass line and comprising a flow rate sensor, by-pass line opening and closing means, and a by-pass flow rate regulator. The numeral 8 is a water supply pipe connected to delivery pipe 7 and to which are attached a number of faucets 9 as are found in a common home. The numeral 12 is a pressure switch which is turned ON in response to a decrease in the applied pressure and OFF in response to a decrease, thereby actuating or halting operation of motor 1 in response to changes in pressure experienced in delivery pipe 7 or water supply pipe 8. The numeral 11 is a pressure tank of extremely small size connected to delivery pipe 7, and 3 is a well.

Figure 3:
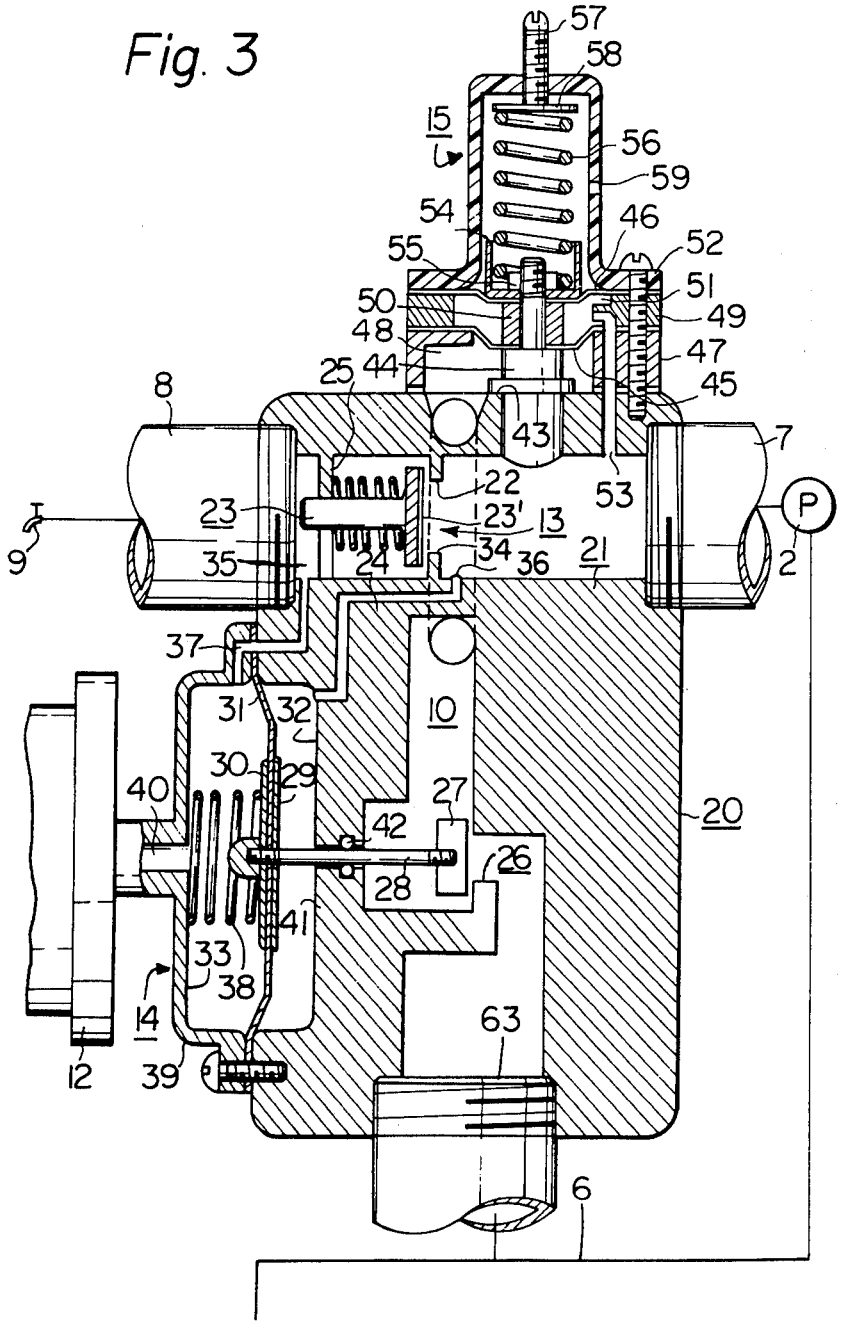
FIG. 3 illustrates a cross-sectional view of the water regulating section of the present invention.

FIG. 3 is a cross-sectional view of water regulator 20 illustrated in FIG. 2. The main assembly of water regulator 20 includes pump delivery pipe 7, water supply pipe 8 and suction pipe 6 associatively connected, as well as flow rate sensor 13, by-pass flow rate regulator 14, pressure regulator 15 and pressure switch 12. Flow rate sensor 13 is provided in main flow passage 21 defined between delivery pipe 7 and water supply pipe 8, and is comprised of valve seat 22, resistance valve body 23 freely openable and closable in valve seat 22, spring 24 biasing valve 123 in valve seat 22 from the downstream side and signal passages 36 and 37 for supplying therethrough a pressure signal to by-pass flow rate regulator 14. Low resistance valve body 23 is supported in member 25 and is provided with a groove 23′ on the side facing valve seat 22, as shown in FIGS. 4*a* and 4*b*.

By-pass line 10 branches off upstream of the flow rate sensor of main flow passage 21, leads to suction pipe 6 and is coupled to by-pass flow rate regulator 14 which comprises valve body 27 facing valve seat 26 located in a section of by-pass line 10, operating shaft 28 joined to valve body 27, and diaphragm 31 joined to operating shaft 28 via abutting plates 29 and 30. On either side of diaphragm 31 are pressure chambers 32 and 33 provided with signal pressures via respective signal passages 36 and 37 from the input side 34 of low resistance valve 23 of flow rate sensor 13 and from the vicinity of the output side and 35, respectively. Moreover, diaphragm 31 is biased by spring 38 which functions so as to cause valve body 27 to close the opposing valve seat 26.

One wall 39 of pressure chamber 33 is common with a portion of pressure switch 12 and feeds a pressure signal to the pressure switch via a signal passage 40 located in wall 39. A seal 42 is provided in the hole passing through wall 41 through which operating shaft 28 connects with diaphragm 31, thereby sealing by-pass passage 10 from pressure chamber 32.

Pressure regulator 15 is located in that portion of main flow passage 21 from which by-pass passage 10 diverges. This pressure regulator comprises valve seat 43 which also serves as the by-pass passage inlet provided upstream of flow-rate sensor 13, control valve body 44 facing valve seat 43, first actuating member 45 comprising a diaphragm joined to control valve body 44, and second actuating member 46 also comprising a similar diaphragm.

A chamber 48 is formed below the first actuating member 45 and, extending from housing 47, communicates with the main portion of by-pass flow passage 10 through passage 41. A pressure chamber 51 is formed between the first actuator 45 and second actuator 46 by means of housing 49 and spacer 50, the outer surface of the second actuating member 46 being attached to the housing 52. The pressure chamber defined between the first and second actuating members 45 and 46 is provided with a pressure signal from main flow passage 21 via pressure signal passage 53. Attached to the back side of the second actuating member 46 are an abutting plate 54 and nut 55 while a spring 56 is confined within housing 52 and arranged to bias control valve 44 in a direction which closes valve seat 43. Housing 52 also includes an adjustment screw 57 the rotation of which allows the pressure applied via plate 58 to be adjusted. Housing 52 is equipped with through hole 59 open to the atmosphere so as to apply atmospheric pressure upon the back side of second actuating member 46. Further, the size of the pressured surface area of second actuating member 46 is greater than is the case with the first actuating member 45; that is, approximately 1.3 times greater.

According to the structure of this invention as described in FIGS. 1 to 3, water stored in small-scale pressure tank 11 is admitted into delivery pipe 7 and water supply pipe 8 when faucet 9 is opened, both pipes having experienced a drop in pressure. This in turn reduces the pressure applied upon pressure switch 12 which therefore turns ON and causes motor 12 to operate. Water is then drawn up from well 3 due to the action of pump 2, rises through foot valve 19, suction pipe 6 and is fed to delivery pipe 7 of pump 2 as highly pressured water.

A case will now be described in which faucet 9 is turned to the wide open position.

A large flow rate through delivery pipe 7 and water supply pipe 8 is produced which causes resistance valve 23 body of flow rate sensor 13 to move to the left against the spring 24. Accordingly, a pressure loss between main flow passage 21 and the output side 35 of low resistance valve body 23 attains a value set by spring 24 and the spring area of valve seat 22, thereby producing a difference in pressures between signal pressure passages 36 and 37. Consequently, diaphragm 31 located in by-pass flow rate regulator 14 which receives the pressure signal moves to the left against the force of spring 38, thereby removing valve body 27, to which it is connected, from valve seat 26, causing a state of communication between by-pass passage 10 and suction pipe 6.

Although pressure switch 12 is subject to pressure via signal passage 37, pressure chamber 33 and signal passage 40, the switch continues to remain in the ON condition due to the fact that the pressure in water supply pipe 8 is low.

On the other hand, control valve body 44 of pressure regulator 15 is applied with a force equivalent to the pressure differential between the atmospheric pressure acting upon second actuating member 46, the pressure within delivery pipe 7, and is further applied with a force equivalent to the pressure differential between the delivery pipe 7 of first actuating member 45 and the pressure of the suction pipe 6. However, the size of the pressured surface area of the first actuating member per unit area is less than the second, causing the valve to experience an upwardly acting force. The valve also receives an upwardly acting force due to the pressure exerted upon the valve seat. Nevertheless, since spring 56 is biased downward, control valve body 44 keeps valve seat 43 closed until the pressure of delivery pipe 7 reaches a predetermined set value. Accordingly, there is no flow through by-pass passage 10 so that the entire output flow from pump 2 is fed through water supply pipe 8.

A case will now be described in which faucet 9 is gradually closed.

The pressure in delivery pipe 7, that is, in main flow passage 21, gradually rises, causing control valve body 44 to overcome the force of spring 56 and rise in pressure regulator 15, thus opening the valve. Valve seat 43 and chamber 48 are accordingly brought into communication, producing a flow through by-pass passage 10. In this case, valve body 27 installed in by-pass flow rate regulator 14 has opened valve seat 26, creating a by-pass flow leading to suction pipe 6. As a result, even if delivery pipe 7 experiences a further increase in pressure, the opening of control valve body 44 of pressure regulator 15 is proportionally adjusted by spring 56 so that despite the flow rate through water supply pipe 8, the pressure is held at an approximately uniform level.

A case will now be described in which faucet 9 is completely closed.

As the flow through water supply pipe 8 ceases, low resistance valve body 23 of flow rate sensor 13 closes valve seat 22. However, due to the groove 23' formed in low resistance valve body 23, the pressure differential between the in-flow and out-flow sides 34 and 35 of the valve is completely cancelled. This causes equivalent pressures to be applied to pressure chambers 32 and 33 of by-pass flow rate regulator 14, thereby allowing spring 38 to urge diaphragm 31 to the right so as to close valve seat 26 by valve 27. This cuts off the flow of water through by-pass flow passage 10, subjecting pressure switch 12 to a pump cut-off pressure, thereby turning pressure switch 12 OFF so as to terminate operation of electric motor 1 and, accordingly, pump 2.

The operation as outlined above is shown by means of a graph in FIG. 5. Here, the output pressure of Wesco pump 2 is restricted below a fixed value irrespective of the flow rate in the water supply pipe; when the flow rate in water supply pipe begins to fall below Qc, pump 2 produces the original delivery pressure.

In the graph, the chain line Qa-w represents the power consumption of motor 1 which drives pump 2, and the characteristic lines Qb—Pb and Qb—w represent the performance of a conventional Wesco pump.

The characteristic value of Qa—Pa can be set over a wide range by the adjusting screw 57 of pressure regulator 15. In other words, following assembly of the pump or even after connecting the water regulator 20 to a pump with a different capacity, it is possible to bring the Qa—Pa characteristic below the pressure which turns the pressure switch 12 OFF. Further, it is possible to obtain a stable Qa—Pa characteristic merely by employing the adjustment screw 57 to absorb fluctuations in the set pressure arising from disparities in flow passage construction. Thus, in keeping with the foregoing, motor 1 is not subject to overload.

FIG. 6 illustrates a liquid signal pressure differential for the flow rate sensor 13. Here, the curve *a* represents the fluidic resistance of resistance valve body 23 having the groove 23', the curve *b* the fixed pressure characteristic produced by the action of resistance valve body 23 and spring 24. As for the over-all characteristics, resistance valve body 23 is urged against valve seat 22 by spring 24 when the flow rate through water supply pipe 8 is small, whereby the pressure differential follows a fluidic resistance curve determined merely by groove 23'. When the flow rate gradually increases, the pressure differential rises causing resistance valve body 23 to move to the left against spring 24 so as to maintain the pressure differential at a fixed value.

Flow rate Qc is set in value as determined by the size of diaphragm 31 of by-pass flow regulator 14 and in relation to the force of spring 38. The distinctive feature of the fixed pressure characteristic for the resistance valve 23 rests in the fact that the pressure loss in flow rate sensor 13 is reduced and suppressed even when the flow rate in water supply pipe 8 increases. Moreover, a sufficient pressure differential is formed even when the flow rate decreases. When the pressure loss is small, it is possible to transmit fully the output power from pump 2 to water pipe 8.

Resistance valve body 23 is equipped with groove 23' in order to reduce to zero the pressure differential between the signal passages 36 and 37 connected to the input and output sides 34 and 35 of resistance valve body 23 when the flow rate in water pipe 8 falls to zero. Groove 23' also assures that valve 27 of by-pass flow rate regulator 14 will close. Moreover, the shape of the groove 23' is extremely effective in preventing the accumulation of contaminants during the operation of pump 2. For example, holes when employed are apt to become blocked by contaminants and offer problems with respect to smooth water flow, whereas a groove-like configuration facilitates further flow, thereby making it possible to avoid operational difficulties.

By-pass flow regulator 14 is set to operate at a predetermined value Qc which is not zero, this in order that continuous operation is avoided should there be a leak in water pipe 8 or faucet 9. Continuous pump operation due to small leaks is economically disadvantageous; for this reason Qc is assigned a predetermined value and not zero.

In conformance with the operation as outlined above, motor 1 of pump 2 of Wesco type is not subjected to overload and, moreover, the number of ON-OFF operations of pressure switch 12 does not exceed the number of times faucet 9 is opened and closed so that the lifetime of the switch can be extended.

FIG. 7 illustrates another embodiment of pressure regulator 15. The present embodiment is completely identical in operation to the above-mentioned regulator although the repulsive force of magnets 60 and 61 are employed in lieu of spring 56. The repulsive force is adjusted by means of adjustment screw 62 which varies the gap between the magnets.

Returning to FIG. 2, the distance to the water table Hs is subject to large variations according to regional and climatic conditions. When Hs changes, the pressure of suction pipe 6 varies thereby to change the pressure on the suction pipe 6 side of the by-pass flow passage 10. Further, as shown in FIG. 9, as the distance Hs varies from zero to eight meters, the output pressure of Wesco pump 2 varies from X1 to X2. At this time, when the opening of control valve 44 of pressure regulator 15 is fixed, the output pressure on water pipe 8 decreases from Y1 to Y2, the reason being that since the output pressure of pump 2 changes froms X1 to X2, the pressure of water pipe 8 can be held fixed only if the flow rate through by-pass flow passage 10 is made to change from Qd1 to Qd2. However, when the size of the valve opening is fixed, the pressure at point A shifts to point B and the above-mentioned characteristic from Y1 to Y2 suffers a change. This causes a dis-advantageous drop in the pressure of water supply pipe 8.

FIG. 8 illustrates another embodiment of the pressure regulator 15 of the present invention, the operation of which will now be described.

The pressure differential exerted upon first actuating member 45 of pressure regulator 15 is equivalent to the pressure differential between delivery pipe 7 and the area 63 on the suction pipe side. Since the pressure exerted upon valve body 44 from the valve seat 43 can be ignored, a pressure applied upon the area $A_3$–$A_2$ acts to urge control valve 44 upwardly against the actuating member 4. Now, if the diameter of control valve 44 is set to be equal to $A_2$, $A_1$–$A_2$ will be related to $A_3$–$A_2$. If this is the case, control valve 44 will undergo no change of position even if the pressure Ps of area 63 changes. Should $A_1$–$A_2$ exceed $A_3$–$A_2$, Ps will increase making it possible to cause control valve 44 to move in the closing direction. Accordingly, as shown at point A in FIG. 9, it is possible to raise the pressure of water pipe 8 to $Y_1$ at by-pass flow rate Qd2. As for the control characteristic, variations from the $Y_1$ characteristic will not occur even if there are changes in the well distance Hs.

FIG. 10 illustrates the structure of the conventional pressure control mechanism, wherein the numeral 65 represents packing, 66 a valve houding, 67 a diaphragm, and 68 a housing, these four members being secured to a water regulator 20 by means of a bolt 69. Valve body 70 is secured by nut 71 to supporting member 72 and diaphragm 67. Spring 73 applies a force upon valve body 70 through supporting plate 74, adjustment screw 75 and supporting member 72. The interior of housing 68 is at atmospheric pressure due to opening 76.

With regard to the operation of this mechanism, main flow passage 21 extending from delivery pipe 7 to water supply pipe 8 communicates with chamber 77 of valve body 70 such that when the pressure of delivery pipe 7 rises, the pressure exerted upon diaphragm 67 increases so that it overcomes the force of spring 73. A by-pass flow is then produced from chamber 77 to area 63, whereafter operation is identical to that of the pressure control mechanism of this invention as previously described. However, the conventional mechanism is beset by the following disadvantages.

The distance to the water table through suction pipe 6 increases when the well distance Hs begins to increase. Accordingly, as area 63 is joined to suction pipe 6 through by-pass flow passage 10, the negative pressure of area 63 increases due to a number of factors. Such factors include, for example, regulating the opening of faucet 9 or pulsed movement of the impeller wheel. Thus, the pressure at the lower surface 78 of valve body 70 must simultaneously be given a negative pressure. This corresponds to a force acting so as to lower valve body 70, whereby valve 70 is urged downward irrespective of the force applied by diaphragm 67, thereby to narrow flow passage 79. Since the flow rate is now restricted, the negative pressure of area 63 is forced to attain a still greater nagative value producing a negative pressure wave transmitted to the well side end of suction pipe 6 which is then returned by reflection. This reinforces the previous action, urging valve body 70 downward and further enlarging the value of the negative pressure wave. There is thus the danger that suction pipe 6 will be subject to damaging vibration caused by the up-and-down movement of valve body 70 and the transmission and reflection of the pressure wave.

As means for preventing this vibration phenomenon, it is possible to install a surging tank for mitigating the pressure waves in the area 63 and suction pipe 6. However, it has been confirmed through experimentation that if, in the apparatus of the present invention, the area of applied pressure on first actuating member 45 is set to less than 1.3 times the area of the opening and closing portion 63 of the valve, the vibration phenomenon can be attenuated.

This attenuation of vibration can be accomplished for the following reason. In FIG. 8, valve body 44 is acted upon by forces resolved into a force which urges the valve upward along the area A3 – A2 and a force which urges it downward along the area A1 – A2. If this force differential observes the above-mentioned condition wherein A1 ≧ 1.3A3, control valve body 44 can be prevented from being urged downward in an excessively extreme manner. In other words, the force differential is considerably smaller than the force experienced in the former structure illustrated in FIG. 10. Accordingly, there is no amplification of the pressure wave in area 63, allowing the pressure wave to be attenuated and nullified.

Next, in comparing the apparatus of the present invention to that of the prior art, an explanation will be given as to why a large quantity of water is provided by the pressure tank.

According to the characteristics of FIG. 5, the pump delivery pressure cannot be enlarged beyond the pressure which turns the pressure switch OFF, this being necessary to prevent overloading of the motor. For example, in other mechanisms which drive the pump through the pressure switch irrespective of the delivery pressure, the flow rate through the water pipe decreases and the pressure switch must be turned OFF when it begins to operate in relation to the delivery pressure. Consequently, it is necessary that the pressure suitable for turning the pressure switch OFF be brought below the characteristic Qa — Pa. On the contrary, however, the pressure cannot be greatly lowered since it is necessary to consider cases where the pressure for turning the pressure switch ON is set to the rising head of the pump outlet pipe; for example, a case where the pump is the first floor and the faucet the second floor, etc. In other words, when the head increases, there will be cases when the pressure switch does not turn ON. Accordingly, the pressure for turning on the pressure switch cannot fall to an exceedingly low level.

On the other hand, when only the pressure for turning the pressure switch OFF is lowered, the amount of water stored in the pressure tank decreases.

Accordingly to the present invention it is possible to greatly increase the pressure for turning the pressure switch OFF. This is accomplished by maintaining the pump delivery pressure at a highly loaded state below Qc for a short period of time.

FIG. 11 illustrates another embodiment of the present invention incorporating a flow rate sensor and a by-pass opening and closing mechanism. The embodiment puts to use the operation of a flow rate sensor resistance valve and employs a simplified structure.

Resistance valve body 23 of the flow rate sensor 13 has groove 23' in its end face to serve as a flow passage and is biased against valve seat 22 by spring 24. Further, valve seat 22 is circularly shaped and is supported at its outer periphery in the housing of water regulator 20 via a diaphragm shaped connectable member 80. Changes in the position of the valve seat 22 act so as to open or close by-pass outflow port 81 formed on the inlet side area 34 of resistance valve body 23. By-pass outflow port 81 also communicates with by-pass passage 10 and pressure regulator 15.

In the drawing, parts which operate in a manner similar to those already described are designated by identical reference numbers.

According to a feature of the present embodiment, water pumped up from suction pipe 6 in a case where the flow rate is greater than Q2 in FIG. 12 is fed from delivery pipe 7 to flow rate sensor 13, thereby changing the position of resistance valve body 23 against spring 24 and supplying well water via water supply pipe 8. At this time, a pressure differential is created between area 34 on the inlet side of resistance valve body 23 and area 35 on the outlet side such that valve seat 22 is displaced over its movable distance, opening by-pass outlet port 81. Accordingly, delivery pipe 7 is communicated with by-pass passage 10.

When the flow rate from faucet 9 is extrenely small and falls below the value Q1 in FIG. 2, resistance valve body 23 is urged by the force of spring 24, sealing valve seat 22. However, since resistance valve body 23 is equipped with groove 23', there is a small flow of water through the water supply pipe 8 via the groove 23'. In such a case the pressure differential between zones 34 and 35 on the inlet and outlet sides of valve body 23 is reduced, allowing spring 24 to urge valve body 43 into a position which closes by-pass outflow port 81 thereby to block the by-pass passage. As a result of this blockage the output pressure of pump 2 returns to the original characteristic so as to the characteristic C in FIG. 12, opening pressure switch 12 and terminating operation of pump 2.

According to the present embodiment, valve seat 22 of flow rate sensor 13 is displaceable in accordance with the pressure differential of the resistance valve so as to control the opening and closing operation of the by-pass passage. It is therefore possible to simplify the flow passage system since a separate by-pass regulator need not be installed.

FIG. 13 illustrates another embodiment of this invention, namely, a construction in which pressure regulator 15 and pressure switch 12 are combined into an integrated structure. By-pass flow passage 10 communicates with delivery pipe 7 and suction pipe 6 and is further communicated with pressure regulator 15 and by-pass flow regulator 14. Control valve 44 of pressure regulator 15 is combined with diaphragm 82 and disposed so as to open or close valve seat 43 in response to spring 83 which urges the valve toward valve seat 43.

Pressure switch 12 comprises an operating plate 85 operable in response to operating member 84 of control valve body 44, a movable contact leaf 86 operable in snap-like fashion in response to the action of operating plate 85, a fixed contact 87, and a spring 88 for snap-like action. Spring 83 rests on operating plate 85 so as to apply a force upon control valve 44.

By-pass flow rate regulator 14 has the construction as described above and operates in an identical manner.

Turning now to an operational description of by-pass flow passage 10, the outlet pressure of pump 2 is applied upon zone 89 at the lower portion of control valve 44 of regulator 15. In other words, when faucet 9 is in the process of being closed the amount of water supplied is reduced, thereby raising the pressure in by-pass passage 10 and zone 89, raising diaphragm 82 against spring 83. Valve seat 43 is thus opened, allowing a portion of the flow from pump 2 to flow into by-pass passage 10. When faucet 9 is closed further, diaphragm 82 rises, the flow rate through the by-pass passage increases, and the over-all flow rate as provided by pump 2 is held fixed rather than being allowed to diminish. When the force which spring 83 applies upon diaphragm 82 of by-pass flow rate regulator 15 is adjusted, this determines the pressure within zone 89 at which diaphragm 82 is caused to rise; valve seat 43 thus will not open until zone 89 attains this pressure. Consequently, despite any number of changes in the flow rate at faucet 9, the flow rate as provided by pump 2 will be maintained at or above $Q_2$ as shown in FIG. 12.

When faucet 9 is completely turned off, the flow through flow rate sensor 13 ceases and by-pass flow regulator 14 blocks by-pass flow in response to the flow rate sensor in conformance with the operation as described above. The flow rate through by-pass passage 10 thus decreases and the pump output pressure rises above point $Q_1$ in FIG. 12. The pressure at delivery pipe 7 and zone 89 rises above the pressure for turning pressure switch 12 OFF and, in connection with this, diaphragm 82 experiences a large upward movement. This in turn raises operating plate 85 whereby movable contact leaf 86 moves downward by a snap-action, breaking contact with fixed contact leaf 87 so as to open the contacts. In other words, switch 12 is opened so as to terminate operation of the motor and shut off pump 2 which supplies the well water.

According to the apparatus of the embodiment, the pressure switch and pressure regulator are able to carry out their respective independent functions and operate together when faucet 9 is closed so as to assure that pressure switch 12 will switch OFF and function reliably. Moreover, costs can be reduced considerably owing to a small number of parts.

FIG. 14 is yet another embodiment of the present invention in which the valve means for the by-pass flow rate regulator are replaced by the valve means for the pressure regulator.

Signal pipes 36 and 37 from flow rate sensor 13 attached to water supply pipe 8 are connected to control valve means 90. As shown in FIG. 15, control valve means 90 includes pressure chamber 91, pressure-responsive diaphragm 92, valve seat 93 opened and closed by diaphragm 92, spring 94 operative to urge diaphragm 92 against valve seat 93, and flow passage 95 which also includes valve seat 93. The signal pipe from the inlet side of the flow rate sensor and the signal pipe from the outflow side are connected, respectively, to flow passage 95 and pressure chamber 91. Pressure regulator 15 installed in by-pass flow passage 10 includes pressure chamber 96 and flow passage 97, and further comprises a first diaphragm 98 with a comparatively large surface area defining one side of pressure chamber 96, a second diaphragm 99 defining the other side of the same pressure chamber 96 and having a surface area smaller than that of first diaphragm 98 disposed oppositely thereto, a control valve body 100 movable in response to first and second diaphragms 98, 99 for opening and closing flow passage 97, and spring 101 which biases first diaphragm 98 in a direction for causing control valve body 100 to close flow passage 97. The inlet side and the outlet side of flow passage 97 are connected, respectively, to pump delivery pipe 7 and suction pipe 6, with pressure chamber 96 further communicated with signal pipe 102 from control valve means 90. A flow passage 105 is also provided between pressure chamber 96 and suction pipe 6 via filter 103 and fluidic resistor 104.

According to the apparatus shown in FIG. 15 diaphragm 92 of control valve means 90 is urged upward against spring 94 so that flow passage 95 is open. Accordingly, there is a flow of water from control valve means 90 to the pressure chamber 96 of pressure controller 15, said flow reaching suction pipe 6 through filter 103 and fluidic resistor 104. However, by providing fluidic resistor 103 with a large resistance, pressure chamber 96 is held at a pressure substantially equal to the pressure of delivery pipe 7. When the flow rate at faucet 9 attains the value $Q_2$ shown in FIG. 12, diaphragm 92 of control valve means 90 is urged downward by spring 94 due to the small pressure differential between the inlet and outlet sides of flow rate sensor 13. Valve seat 93 is therefore closed and the pressure of delivery pipe 7 is no longer applied to pressure chamber 96 of pressure regulator 15. As a result, the pressure within by-pass flow passage 10 reaches pressure chamber 96 through fluidic resistor 104, bringing chamber 96 to a negative pressure which allows the force exerted by spring 101 to overcome the force exerted upon first diaphragm 98, thereby urging valve body 100 downward in a strong manner so as to close flow passage 97. The rate of flow through by-pass passage 10 is thus reduced, the pressure of delivery pipe 7 rises so as to attain the characteristic value d in FIG. 12, and pressure switch 12 is switched OFF, terminating operation of motor 1 and pump 2.

Since the two members which move control valve body 100 differ with regard to the size of their pressured surface areas, this difference is operable to move control valve 100 when a pressure is applied upon pressure chamber 96 of pressure regulator 15, thereby assuring proper operation. Due to the fact that a negative pressure can be applied upon pressure chamber 96 by means of fluidic resistor 104 connected thereto, is is unnecessary to provide delivery pressure and negative pressure change-over control at control valve means 20, permitting its structure to be simpified.

FIG. 16 illustrates another embodiment of the present invention in which the valve means for the by-pass flow rate regulator are replaced by the valve means for the pressure regulator. This apparatus also includes pressure regulator 15 communicating with by-pass passage 10 and control valve means 90.

Control valve means 90 comprises pressure chambers 107 and 108 partitioned by diaphragm 106, valve seat 109 opened and closed by diaphragm 106, pressure changeover valve body 111 for opening and closing flow passage 110 in response to the same diaphragm 106, spring 112 operative to urge diaphragm 106 into pressured contact with valve seat 109 so as to urge pressure change-over valve body 111 in an opening direction, and communication pipe 113 communicating pressure chamber 108 with flow passage 110 and connected to pressure regulator 15. The pressure at the outlet side of flow rate sensor 13 is impressed upon pressure chamber 108 through signal pipe 114 while the pressure at the inlet side of the sensor is impressed upon pressure chamber 107 through signal pipe 115. Furthermore, the delivery pressure of pump 2 is impressed upon flow passage 110 through signal pipe 116.

Pressure regulator 15 includes pressure chamber 117, and further comprises a first diaphragm 118 with a comparatively large surface area defining one side of pressure chamber 117, second diaphragm 119 defining the other side of the same pressure chamber 117 and having a surface area smaller than that of first diaphragm 118 disposed oppositely thereto, control valve 121 movable in response to first and second diaphragms 118 and 119 for opening and closing flow passage 120, and spring 122 which biases first diaphragm 118 in a direction for causing control valve body to close passage 120. Pressure chamber 117 is communicated with signal passage 113 from control valve means 90, and flow passage 120 is communicated with bypass passage 10.

When the rate of flow at faucet 9 is greater than $Q_2$ in FIG. 12, the pressure differential on either side of flow rate sensor 13 increases, producing a high pressure in signal pipe 115 and a low pressure in signal pipe 114. Since this pressure differential causes diaphragm 106 of control valve means 90 to rise against spring 112, pressure change-over valve 11 responds so as to check the pressure applied from signal passage 113. Signal pipe 115 is at the same pressure as delivery pipe 7, this pressure being applied to pressure chamber 117 of pressure regulator 15 via signal passage 113.

When the amount of water supplied at faucet 9 drops below $Q_2$, an extremely small pressure differential develops between the inlet and outlet sides of the flow rate sensor installed in the line leading to the faucet. As a result, this pressure differential is transmitted through signal pipe 114, raising the pressure in pressure chamber 108, allowing diaphragm 106 to be urged by spring 112 thereby to close valve seat 109 and open passage 110 by lowering pressure change-over valve body 111. This in turn allows pressure chamber 117 of pressure regulator 15 to sense the pressure in suction pipe 6 through signal passage 113, flow passage 110 and signal pipe 116. Since the pressure in suction pipe 6 is a negative or small positive pressure, pressure chamber 117 drops in pressure, the force of spring 122 acting through diaphragm 118 urges control valve body 121 downward, thereby opening by-pass flow passage 110. Accordingly by-pass flow ceases, the pressure in suction pipe 7 attains the characteristic value *d* in FIG. 12, the pressure rises to a value suitable for turning pressure switch 12 OFF, and pump 2 ceases to operate.

According to the construction of the apparatus shown in FIG. 16, a pressure regulator is equipped with a member operative to move a control valve body in response to a pump delivery pressure, and is also provided with another member operative to move a control valve body by sensing a pressure differential between the delivery pressure and the pressure in a suction pipe, such controlling pressure being changedover between the delivery pressure and the suction pipe pressure in conformance to the outlet flow rate. This makes operation possible without requiring a pressure tank and without increasing the number of times a pressure switch must turn ON and OFF, thereby providing pumping equipment which is highly durable, small in size and low in cost. Moreover, since the two members which move the control valve body differ with regard to the size of their pressured surface areas, this difference is operable to move the control valve body when the delivery pressure is applied upon the pressure chamber of the by-pass flow rate regulator, thereby assuring proper operation.

Thus, as described in the foregoing, a domestic shallow well pump which employs the water regulating and pressure regulating means of the present invention makes it possible to prevent an increase in the number of violent ON-OFF operations of a pressure switch even if the large-scale tank of the prior art is removed in practice. It is also possible to prevent electric motor overload when a Wesco-type pump is used while simultaneously uniformalizing fluctuations in the water supply pipe pressure by means of the pressure regulating means. Consequently, inconvenient equipment for suppression of vibration may be eliminated. Moreover, system vibration can be prevented by the characteristic configuration of the pressure regulating means. It is also possible to realize equipment which is compact and light in weight without giving rise to any problems whatsoever.

What is claimed is:

1. Automatically operative pumping equipment comprising:

a pump having a fluid delivery pipe and a fluid suction pipe;

an electric motor operative to drive said pump for pumping fluid;

a pressure switch positioned for sensing fluid pressure in said delivery pipe and operative to control said electric motor in response to the pressure in said delivery pipe;

a by-pass passage branched off from said delivery pipe and connected to said suction pipe for defining a fluid flow path from said delivery pipe back to said suction pipe;

a pressure regulator connected in said by-pass passage for controlling the flow rate through the by-pass passage by sensing the fluid pressure in the delivery pipe to maintain said pressure below a value which turns said pressure switch ON;

a flow rate sensor for sensing the flow rate through the delivery pipe downstream from said by-pass passage branch and for producing a pressure signal representing same; and a by-pass passage flow rate regulator responsive to a control pressure signal and connected to said flow rate sensor to receive the flow rate sensor pressure signal for opening and closing the by-pass passage in response to the pressure signal from said flow rate sensor.

2. Automatically operative pumping equipment according to claim 1, wherein the by-pass passage opening and closing device communicates with the signal passage of the flow rate sensor and has a movable member displaced in response to a signal from said signal passage and further comprises valve means for regulating the flow rate through the by-pass passage joined to said movable member, whereby the valve means limited the by-pass flow rate to a value which turns the pressure switch ON when the delivery pipe flow rate below the by-pass passage branch is below a predetermined flow rate.

3. Automatically operative pumping equipment according to claim 1, wherein the flow rate sensor includes a member which opens and closes in response to the flow rate through the delivery pipe below the by pass passage branch;

a side passage disposed at said opening and closing member; and signal passages opened at the inlet and outlet sides of said opening and closing member, whereby a pressure differential produced between the inlet and outlet sides of said opening and closing member is obtained.

4. Automatically operative pumping equipment according to claim 3, wherein the side passage of the opening and closing members of the flow rate sensor includes a groove formed in said opening and closing member.

5. Automatically operative pumping equipment according to claim 1, wherein the valve seat of the opening and closing member of the flow rate sensor is displaceable in response to a pressure differential, whereby the by-pass passage is opened and closed by displacement of said valve seat.

6. Automatically operative pumping equipment according to claim 5, wherein the opening and closing member comprises a valve seat and a valve body urged against the valve seat by a spring, the valve seat being supported in the housing by means of a contactable member and displaceable in response to a pressure differential between the inlet side and outlet side of the valve body, whereby a by-pass outlet port provided at the valve inlet is opened and closed.

7. Automatically operative pumping equipment according to claim 6, wherein the valve body which contacts and separates from the valve seat of the opening and closing member includes a leakage passage.

8. Automatically operative pumping equipment according to claim 1, wherein the pressure regulator includes a pressure chamber formed between the first operating member and second operating member, and a member for regulating the by-pass passage by means of said operating members, the signal passage leading to the pressure chamber being equipped with changeover means responsive to a signal from said flow rate sensor, whereby the pump delivery pressure and the suction pipe pressure are changed-over and impressed upon the pressure regulator.

9. Automatically operative pumping equipment according to claim 8, wherein the change-over means comprises an operating member dispaceable in response to a signal from said flow rate sensor, and a valve member joined to said operating member, communication between the delivery pipe signal passage and the pressure chamber, and between the suction pipe signal passage and the pressure chamber being changed-over by means of said valve member, whereby the by-pass passage is closed by communicating said suction pipe signal passage with the pressure chamber when the delivery pipe flow rate below the by-pass passage is below a predetermined flow rate.

10. Automatically operative pumping equipment according to claim 1, wherein the pressure regulator includes:

a first operating member operative in response to the pressure in the delivery pipe;

a second operating member operative in response to a pressure differential between the delivery pipe and suction pipe; and opening and closing members linked to said first and second members.

11. Automatically operative pumping equipment according to claim 10, wherein the first and second operating members are constructed of flexible members, the size of the effective pressured surface area of said second operating member being relatively smaller than the size of the effective pressured area of the first operative member and having an area approximately 1 to 1.3 times greater than the area of the valve seat opening and closing member of the opening and closing means.

12. Automatically operative pumping equipment according to claim 2, wherein the pressure switch is integrally combined with the pressure regulator installed in the by-pass passage so as to be coupled to the movable member of said pressure regulator.

13. Automatically operative pumping equipment according to claim 10, wherein the pressure regulator is equipped with external means for actuating opening and closing means said first operating member operative in response to a pressure differential between the pressure of the delivery pipe and the atmospheric pressure.

14. Automatically operative pumping equipment according to claim 13, wherein the external means of the pressure regulator includes a spring or magnet which is freely adjustable.

15. Automatically operative pumping equipment according to claim 10, wherein the pressure regulator comprises a pressure chamber formed between the first operating member and second operating member, and includes a member operative to regulate the by-pass passage by means of said operating members, whereby said pressure chamber is provided with a pressure signal through a control valve device operable in response to a signal from the flow rate sensor.

16. Automatically operative pumping equipment according to claim 15, wherein the pressure chamber of the pressure regulator includes a flow passage which leads to the suction pipe, a fluiding resistance being provided in the flow passage leading to said suction pipe.

17. Automatically operative pumping equipment according to claim 16, wherein a filter is provided in the resistance passage which extends from the pressure chamber of the pressure regulator and leads to the suction pipe.

* * * * *